US009211042B2

(12) United States Patent
Rozek et al.

(10) Patent No.: US 9,211,042 B2
(45) Date of Patent: Dec. 15, 2015

(54) PINCH ROLLER ASSEMBLY FOR A DISPENSER

(75) Inventors: Roy J. Rozek, Neenah, WI (US); Abby C. Case, Green Bay, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 74 days.

(21) Appl. No.: 13/430,434

(22) Filed: Mar. 26, 2012

(65) Prior Publication Data

US 2012/0241548 A1 Sep. 27, 2012

Related U.S. Application Data

(60) Provisional application No. 61/467,247, filed on Mar. 24, 2011.

(51) Int. Cl.

| | |
|---|---|
| ***B65H 49/00*** | (2006.01) |
| ***B65H 16/00*** | (2006.01) |
| ***A47K 10/34*** | (2006.01) |
| ***A47K 10/36*** | (2006.01) |
| ***B65H 27/00*** | (2006.01) |

(52) U.S. Cl.

CPC ..... *A47K 10/34* (2013.01); *A47K 10/36* (2013.01); *B65H 16/005* (2013.01); *B65H 27/00* (2013.01); *B65H 2404/13161* (2013.01); *B65H 2404/14* (2013.01); *B65H 2601/273* (2013.01)

(58) Field of Classification Search

CPC ..... A47K 10/36; A47K 10/34; B41J 15/042; B65H 6/10

USPC ..... 254/564, 564.1, 564.2, 564.3, 564.4, 254/564.5, 565

See application file for complete search history.

(56) References Cited

U.S. PATENT DOCUMENTS

| | | | | |
|---|---|---|---|---|
| 3,223,350 | A * | 12/1965 | Bock et al. | 242/564.4 |
| 4,738,176 | A * | 4/1988 | Cassia | 83/208 |
| 5,452,832 | A * | 9/1995 | Niada | 225/11 |
| 6,079,305 | A * | 6/2000 | Bloch et al. | 83/335 |
| 6,314,850 | B1 * | 11/2001 | Morand | 83/327 |
| 6,363,824 | B1 * | 4/2002 | Granger | 83/334 |
| 6,378,725 | B1 * | 4/2002 | Granger | 221/30 |
| 6,684,751 | B2 * | 2/2004 | Kapiloff et al. | 83/649 |
| 6,820,785 | B2 * | 11/2004 | Kapiloff | 225/14 |
| 6,903,654 | B2 * | 6/2005 | Hansen et al. | 340/562 |
| 7,222,816 | B2 * | 5/2007 | Clark | 242/566 |

(Continued)

FOREIGN PATENT DOCUMENTS

| | | | |
|---|---|---|---|
| WO | 2010/046662 | A1 | 4/2010 |
| WO | 2010/129742 | A2 | 11/2010 |

OTHER PUBLICATIONS

International Search Report and the Written Opinion of the International Searching Authority for PCT/US2012/030607 mailed Oct. 29, 2012.

(Continued)

*Primary Examiner* — Emmanuel M Marcelo
*Assistant Examiner* — Michael Gallion
(74) *Attorney, Agent, or Firm* — Sutherland Asbill & Brennan LLP

(57) ABSTRACT

A pinch roller assembly for a sheet product dispenser includes a roller body and a plurality of clips. The roller body includes a plurality of grooves. The roller body is rotatably associated with the plurality of clips, each clip being disposed in one of the plurality of grooves.

20 Claims, 5 Drawing Sheets

(56) References Cited

U.S. PATENT DOCUMENTS

| | | | | |
|---|---|---|---|---|
| 7,237,744 | B2 * | 7/2007 | Morris et al. | 242/560.1 |
| 7,878,445 | B2 * | 2/2011 | Granger et al. | 242/564.1 |
| 8,376,260 | B2 * | 2/2013 | Granger | 242/566 |
| 8,899,508 | B2 * | 12/2014 | Hjort et al. | 242/564.4 |
| 2006/0138274 | A1 * | 6/2006 | Goeking et al. | 242/564.4 |
| 2007/0079684 | A1 * | 4/2007 | Friesen et al. | 83/649 |
| 2007/0176041 | A1 * | 8/2007 | Friesen et al. | 242/563 |
| 2009/0140001 | A1 * | 6/2009 | Lewis et al. | 221/13 |
| 2010/0012674 | A1 * | 1/2010 | Brownlee | 221/1 |

OTHER PUBLICATIONS

PCT International Preliminary Report on Patentability for International Application No. PCT/US2012/030607 issued Sep. 24, 2013.

* cited by examiner

PINCH ROLLER ASSEMBLY FOR A DISPENSER

CROSS-REFERENCE TO RELATED APPLICATIONS

This application claims priority to U.S. Provisional Patent Application No. 61/467,247, filed Mar. 24, 2011, which is incorporated by reference in its entirety.

BACKGROUND

The present disclosure relates generally to the field of dispensing apparatuses, and more particularly to a pinch roller for a dispensing apparatus for sheet products.

Dispensers for sheet products are known in the art and are available with a wide variety of designs. Typically, dispensers have a drive roller, a pinch roller, and a roll of sheet product. The drive roller and pinch roller together form a nip through which the sheet product passes during dispensing.

One problem with this configuration results when water is present in the dispenser, such as when water is splashed into the dispenser through the dispensing chute. Any combination of the sheet product, the drive roller, and the pinch roller may become wet. In such a case, the sheet product may adhere to the pinch roller or become wrapped around the pinch roller, impeding the dispenser from dispensing properly. A need exists for a dispenser, and more particularly a pinch roller for a dispenser, that addresses this deficiency.

BRIEF DESCRIPTION OF THE INVENTION

A pinch roller assembly for a sheet product dispenser includes a roller body and a plurality of clips. The roller body includes a plurality of grooves. The roller body is rotatably associated with the plurality of clips, each clip being disposed in one of the plurality of grooves.

A dispenser for dispensing sheet product includes a housing, a drive roller, and a pinch roller assembly. Together the drive roller and the pinch roller assembly define a nip configured to receive the sheet product. The pinch roller assembly includes a roller body and a plurality of clips. The roller body has a plurality of grooves. The roller body is rotatably associated with the plurality of clips, each clip being disposed in one of the plurality of grooves.

DETAILED DESCRIPTION

Figure 1:
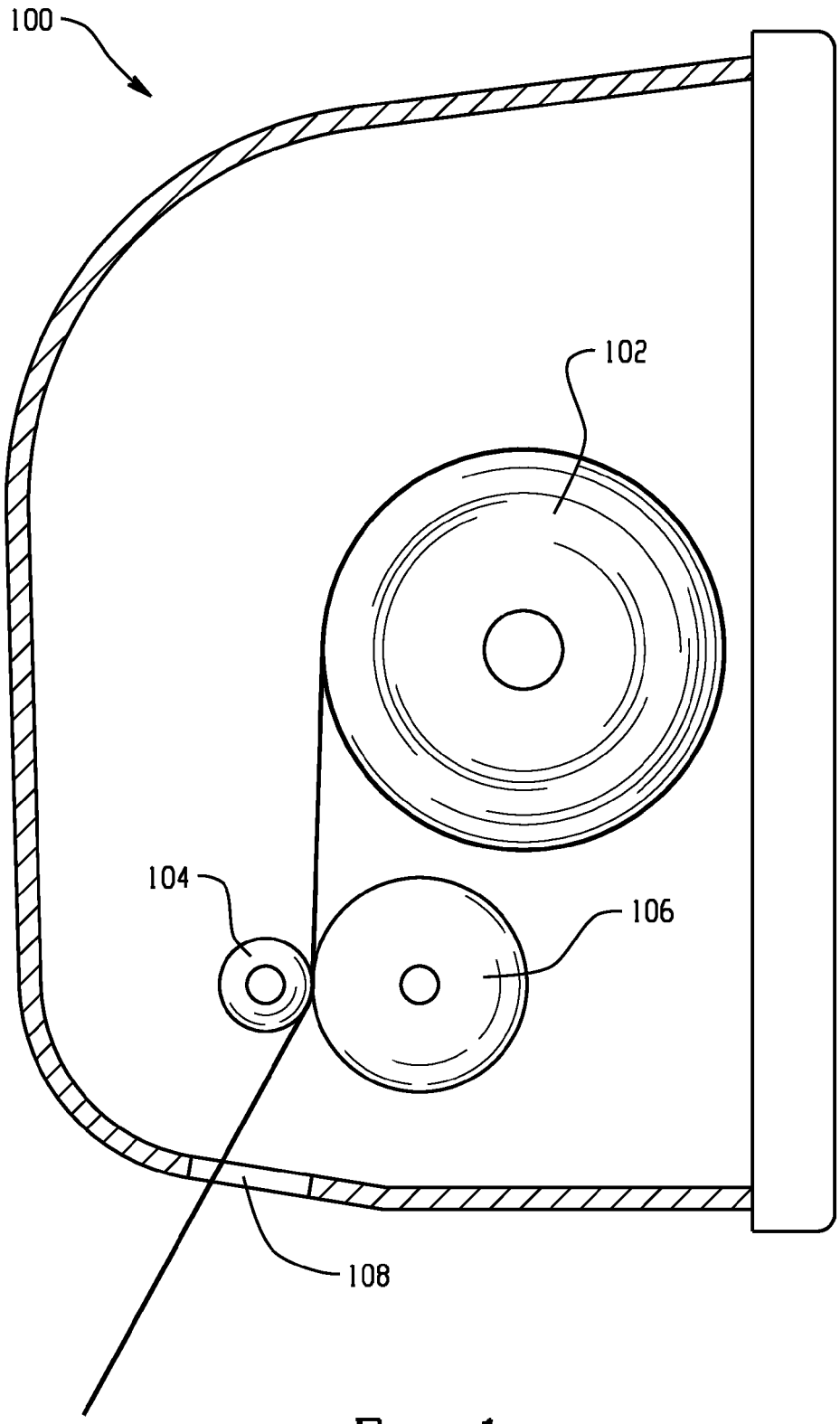
FIG. 1 is a cross-sectional view of an embodiment of a dispenser that can be used with an embodiment of a pinch roller assembly as described herein.

FIG. 1 is a cross-sectional view of an embodiment of a dispenser 100 that is configured to reduce adherence of a dispensed product to one or more dispensing rollers. The dispenser 100 houses sheet product 102, which is disposed about a roll in the illustrated embodiment. So that the dispenser 100 can dispense the sheet product 102 from the roll, the dispenser 100 includes dispensing rollers positioned adjacent to a dispensing chute 108. The dispensing rollers include a pinch roller 104 and a drive roller 106, which together define a nip. When the drive roller 106 is rotated, the sheet product 102 is pulled from the roll through the nip and is dispensed through the dispensing chute 108. For example, the drive roller 106 may be rotated with a motor or a user-actuated mechanism, such as a lever, a button, a wheel, or a user-initiated pulling force upon a tail end of the sheet product external to the dispenser.

In embodiments, the pinch roller 104 may be an embodiment of a pinch roller assembly described herein, which is configured to reduce adherence of the dispensed product to the dispensing rollers during dispensing. It should be noted that FIG. 1 illustrates the dispenser 100 in simplified form for the purpose of illustration, and a person of skill in the art would understand that a wide variety of other mechanical or automated dispensers may be used with the embodiments described herein to dispense rolled or folded sheet products.

Figure 2:
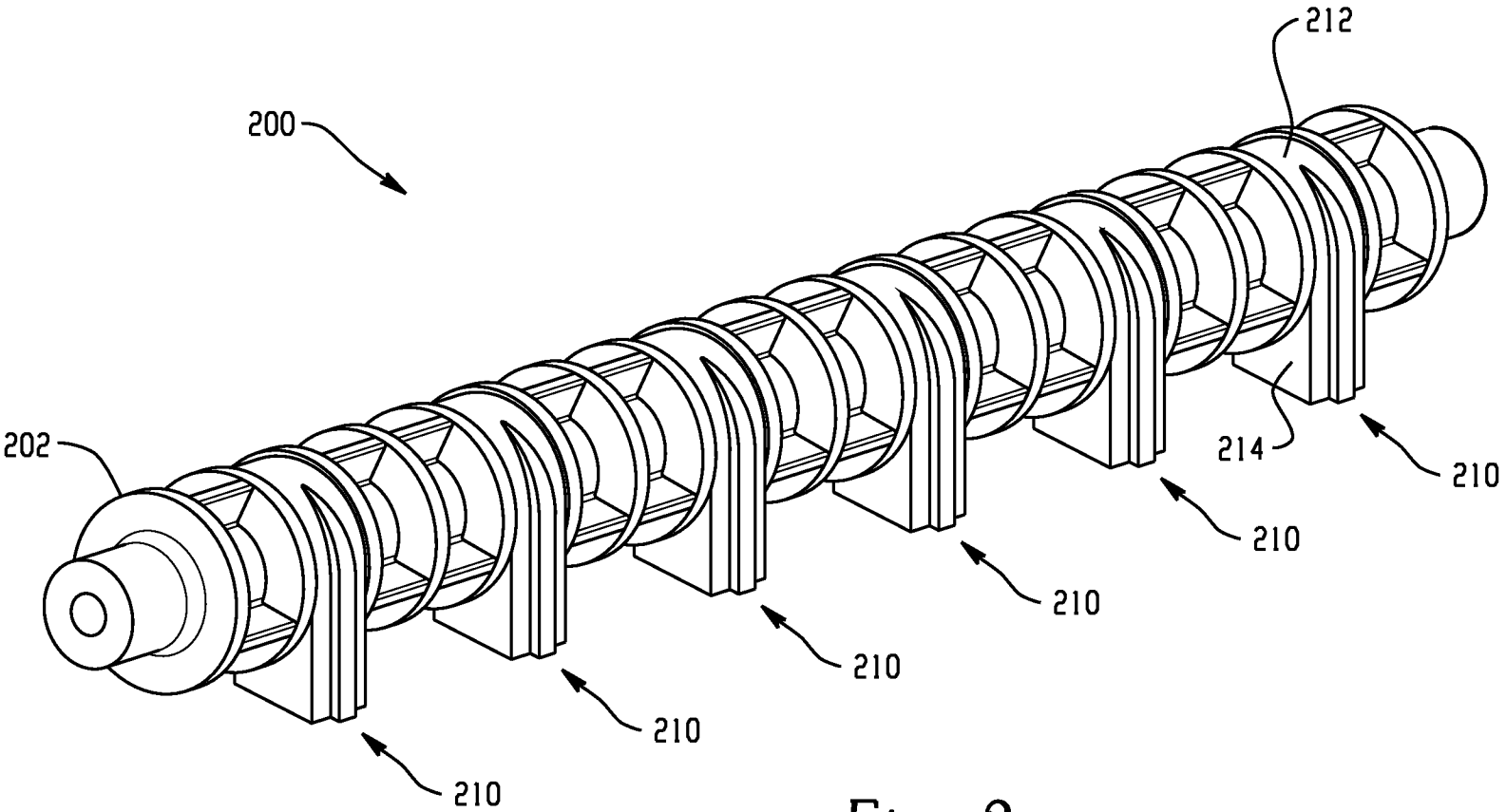
FIG. 2 is a perspective view of an embodiment of a pinch roller assembly that is configured to reduce adherence of a sheet product to one or more dispensing rollers of a dispenser.

FIG. 2 illustrates an embodiment of a pinch roller assembly 200 that is configured to reduce or prevent adherence of the dispensed product to the pinch roller or the drive roller during dispensing. The pinch roller assembly 200 includes a roller body 202 and a plurality of clips 210 that are disposed along the roller body 202. The clips 210 are rotatably associated with the roller body 202 such that the roller body 202 can freely rotate while the clips 210 remain stationary. For example, the clips 210 may abut a portion of the dispenser, such that as the roller body 202 rotates, the clips 210 contact the dispenser and slip with reference to the roller body 202, remaining stationary against the dispenser.

Each clip 210 has a hook portion 212 and a body portion 214. The hook portion 212 mates with the roller body 202, while the body portion 214 extends away from the roller body 202 in a radially outward direction. The hook portion 212 has a maximum outer diameter that is smaller than or approximately equal to a maximum outer diameter of the roller body 202, so that as the roller body 202 rotates during dispensing, the hook portion 212 does not impede the roller body 202 from engaging the drive roller to urge the sheet product towards the dispensing chute. The body portion 214 extends beyond the roller body 202 and abuts a portion of the dispenser, so that the clips 210 remain stationary as the roller body 202 rotates. Because the body portion 214 extends beyond the roller body 202, the clips 210 reduce or prevent sheet product that may have adhered to the roller body 202 from wrapping around the roller body 202 as it rotates.

The number and placement of clips 210 along the roller body 202 are selected to reduce or prevent sheet product from adhering to and wrapping about the roller body 202 during dispensing. In the illustrated embodiment, six clips 210 are disposed along the length of the roller body 202 in spaced positions. However, other numbers of clips 210 may be employed depending on the length of the roller body 200, such as between three and eight clips. The number of clips 210 may be limited such that the clips 210 do not interfere with or inhibit the function of the pinch roller assembly 200. For example, the combined surface area of the clips 210 may constitute approximately twenty percent or less of the surface area of the roller body 202. Because edges of the sheet product may be prone to adhering to edges of the roller body 202, some clips 210 may be disposed adjacent to ends of the roller body 202, such as about one-half to one inch from each end of the roller body 202. However, other configurations are possible.

Figure 3:
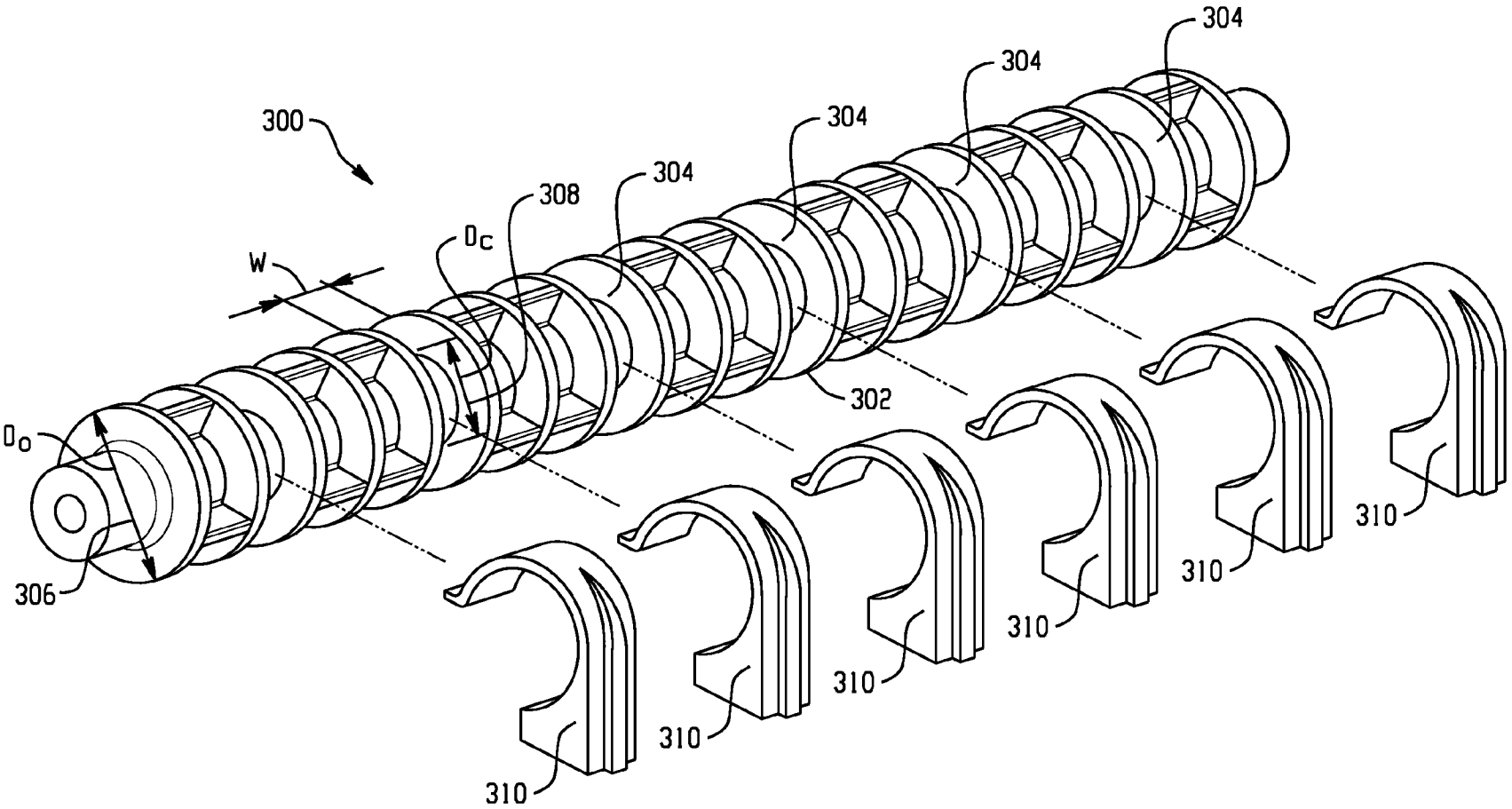
FIG. 3 is an exploded perspective view of a pinch roller assembly that is configured to reduce adherence of a sheet product to one or more dispensing rollers of a dispenser.

FIG. 3 is an exploded perspective view of a pinch roller assembly 300, which includes a roller body 302 and a plurality of clips 310. The roller body 302 has an outer surface and an inner core. The outer surface has an outer surface diameter 306 with a value $D_o$, and the inner core has an inner surface diameter 308 with a value $D_c$ that is less than $D_o$. A plurality of grooves 304 are spaced along the length of the roller body 302, exposing the inner core. The grooves 304 are designed to accommodate the clips 310. Between the grooves 304, at least a portion of the roller body 302 has the outer surface, which contacts the drive roller. For example, the outer surface of the roller body 302 may be solid or continuous between the grooves 304, such that the roller body 302 has the outer surface diameter 306 along its entire length except at the grooves 304 where the inner core is exposed. Alternatively, the roller body 302 may be discontinuous between the grooves 304, having some portions that form the outer surface for contacting the driver roller and other portions that are recessed or completely lack material to expose the inner core. For example, in the illustrated embodiment the roller body 302 has radially extending fins and adjoining ribs that form the outer surface of the roller body 302 for contacting the drive roller, but between the fins and ribs, the roller body 302 lacks material exposing the core.

The clips 310 are sized to fit within the grooves 304 such that the roller body 302 can rotate freely with reference to the clips 310. For example, the dimensions of the clip 310 may be selected to allow the clips 310 to slip with reference to the roller body 302 as it rotates, without the clips 310 disengaging or separating from the roller body 302. In embodiments, the grooves 304 of the roller body 302 are designed receive the clips 310. The grooves 304 have a width W, and the clips 310 have a width w that is less than the width W of the grooves 304.

In embodiments, the roller body 302 may be formed with an absence of material at discrete locations along its length to form the grooves 304, such as by molding. In other embodiments, the roller body 302 may be formed with a solid construction and a portion of the material may be removed to form the grooves 304. In yet other embodiments, the roller body 302 may be constructed from multiple pieces that are subsequently connected, as discussed in more detail with reference to FIG. 5.

Figure 4:
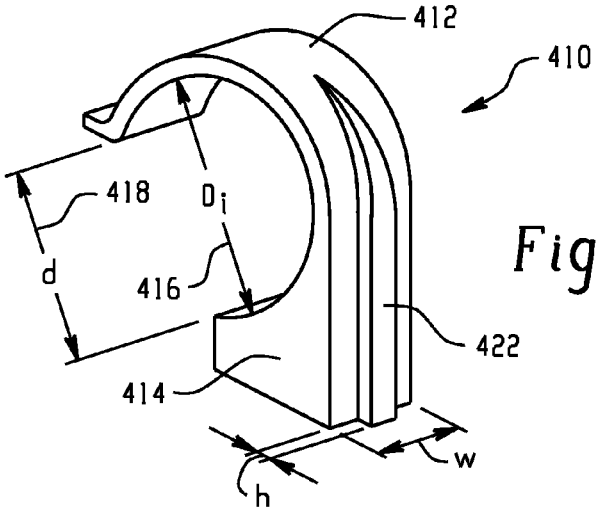
FIG. 4 is a perspective view of an embodiment of a clip of a pinch roller assembly.

FIG. 4 is a perspective view of an embodiment of a clip 410 of a pinch roller assembly, illustrating a hook portion 412 and a body portion 414 of the clip in greater detail. The clip 410 may be formed from a resilient material, such as a plastic, although other materials such as metal may be used. In some embodiments, the hook portion 412 and the body portion 414 may be integrally formed, such as by molding, so that the clip defines a unitary or continuous piece, although the clip also may be formed upon joining two or more pieces that were formed separately.

The clip 410 has a width with a value of w, and in embodiments, the width w is sized to permit the hook portion 412 to loosely fit within the grooves on the roller body. The hook portion 412 has an inner diameter 416 with a value of $D_i$ and an opening 418 with a value of d, and in embodiments, the opening 418 is suitably sized so as to allow the hook portion 412 to snap over the inner core of the roller body in a snap-fit manner, and the inner diameter 416 is sized so as to loosely fit over the inner core of the roller body. As used herein, the term "loosely fit" means a fit that allows unrestrained rotational movement between the roller body and the clip 410 without excessive lateral movement of the clip 410 within the groove that would be contrary to the purpose described and disclosed herein.

In embodiments, the clip 410 has a rib 422 that extends outwardly from the body portion 414. Along an upper region of the hook portion 412, the rib 422 extends out from the clip 410 no farther than the outer diameter of the roller body. The rib 422 progressively increases in extension from the clip 410 around the perimeter of the hook portion 412, and toward the body portion 414 the rib 422 extends beyond the outer diameter of the roller body by a distance h.

In embodiments, the roller body outer surface has a diameter $D_o$ in the range of about 0.7 to 0.8 inches, the roller body inner core has a diameter $D_c$ in the range of about 0.4 to about 0.6 inches, and the clip hook portion has an inner diameter $D_i$ that sized based on the diameter $D_c$ of the roller body inner core so that the parts of the assembly loosely fit together taking tolerances into consideration. For example, in embodiments in which the roller body inner core has a diameter $D_c$ of about 0.50 inches, the clip hook portion has an inner diameter $D_i$ that may be in the range of about 0.51 to 0.53 inches. In addition, the dimension d of the opening into the clip hook portion is suitably sized based on the diameter $D_c$ of the roller body inner core so as to allow the hook portion 402 to snap over the roller body inner core. For example, in embodiments in which the diameter $D_c$ of the inner core is 0.50 inches, the dimension d of the opening into the clip may be between about 0.35 to 0.37 inches.

In embodiments, the width W of the groove on the roller body has a value ranging from about 0.3 to 0.4 inches, and the width w of the clip is sized based on the width W of the groove so that the clip fits within the groove. For example, in embodiments in which the groove has a width W of about 0.36 inches, the clip may have a width w in the range of about 0.30 to about 0.35 inches. In one particular embodiment, $D_o$ is about 0.740 inches, $D_c$ is about 0.500 inches, $D_i$ is about 0.524 inches, d is about 0.364 inches, W is about 0.360 inches, and w is about 0.310 inches. However, other dimensions are within the scope of the present disclosure.

Figure 5:
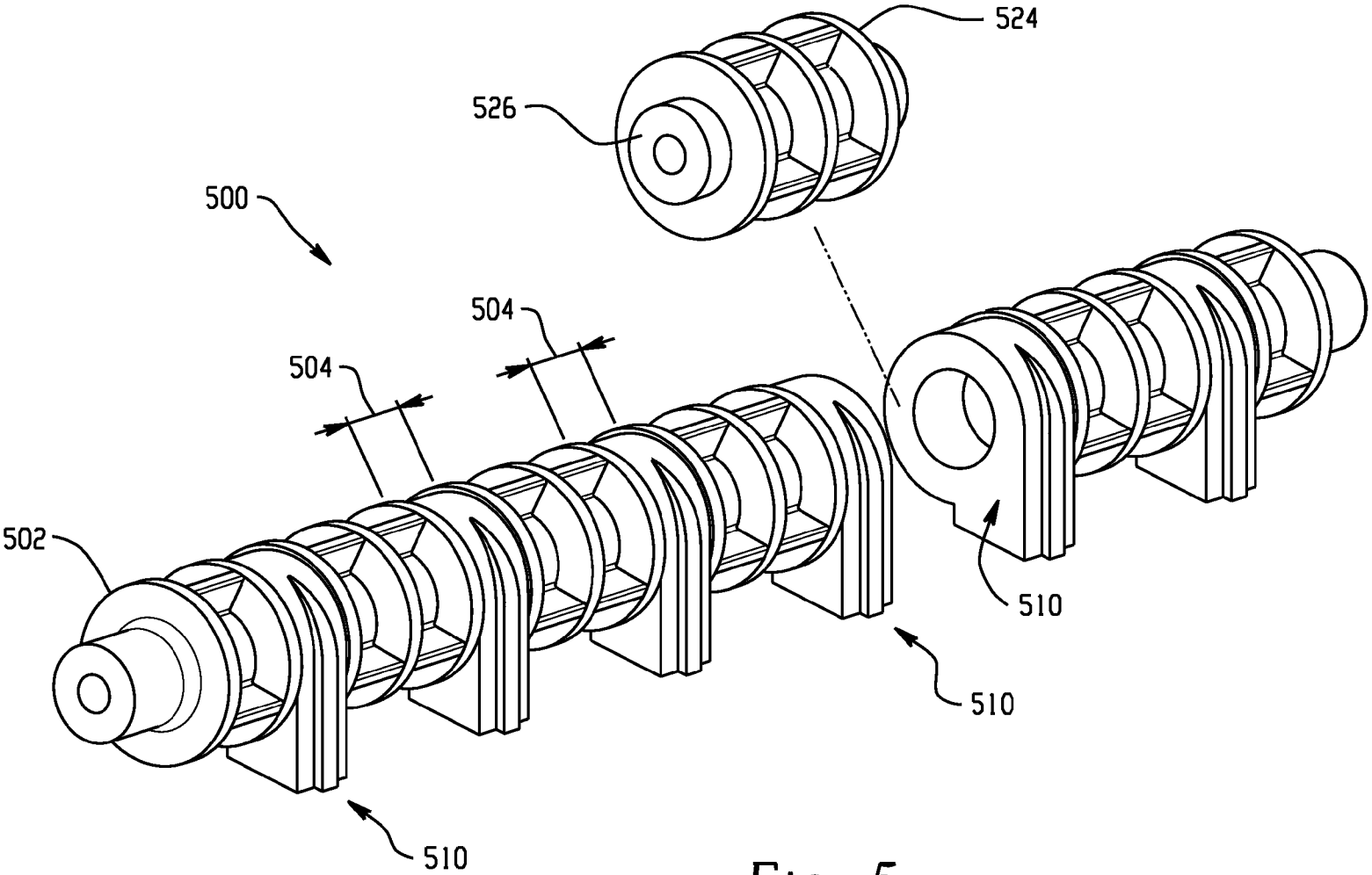
FIG. 5 is a partially exploded perspective view of an embodiment of a pinch roller assembly.

FIG. 5 is a partially exploded perspective view of another embodiment of a pinch roller assembly 500. As illustrated, a roller body 502 of the pinch roller assembly 500 may include a number of pieces 524. In embodiments, the pieces 524 may have tabs 526 that extend from ends of the pieces within grooves 504, and the clips 510 may be placed on the tabs 526 prior to assembling the roller pieces 524 to form the roller body 502. In such embodiments of a pinch roller assembly 500, the clips 510 may completely encircle the roller body 502 instead of snap-fitting about the roller body 502. In addition, a pinch roller assembly 500 that is constructed of a series of pieces may have a variable length, such that the length of the pinch roller 500 can be altered by adding or removing pieces 524 and clips 500 from the pinch roller assembly 500.

Figure 6:
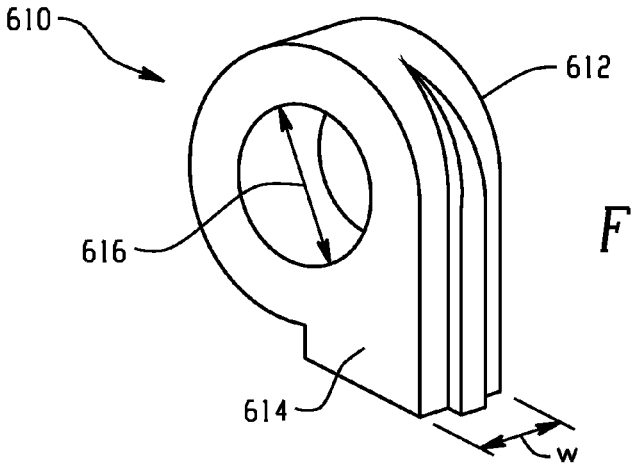
FIG. 6 is a perspective view of another embodiment of a clip of a pinch roller assembly.

FIG. 6 illustrates an embodiment of a clip 610 that can be used with the pinch roller assembly 500 of FIG. 5. The clip 610 has a roller-encircling portion 612 and a body portion 614. In embodiments, the roller-encircling portion 612 and the body portion 614 are integrally formed, such as by molding plastic, although other manufacturing methods and materials can be used. In embodiments, the body portion 612 has a width w and the roller-encircling portion has an inner diameter 616. The inner diameter 616 is suitably sized so as to loosely fit over the core diameter of the roller body, such as along the tab of a piece of the roller body. The width w is sized to permit the clip 610 to loosely fit within the grooves on the roller body.

Figure 7:
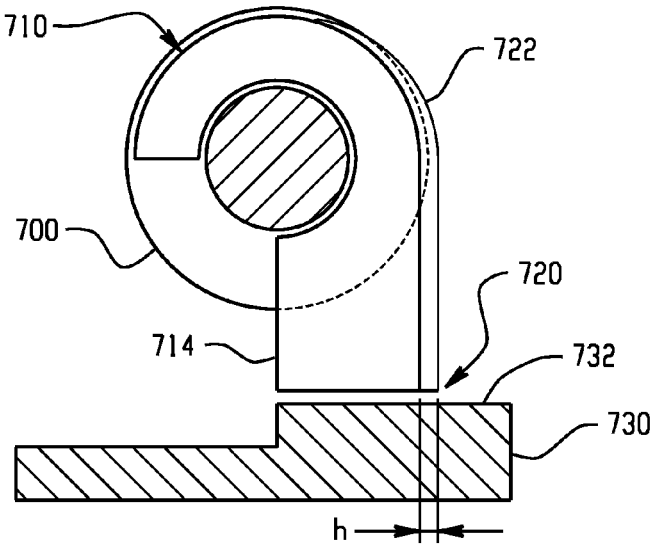
FIG. 7 is a cross sectional end view of an embodiment of a pinch roller assembly disposed in a dispenser.

FIG. 7 is a cross-sectional end view of a pinch roller assembly in accordance with the present disclosure. As illustrated, the pinch roller assembly is mounted in a dispenser, which includes a chassis 730 having a surface 732. The pinch roller assembly 700 is mounted such that a bottom end 720 of the body portion 714 of the clip 710 is positioned adjacent to the surface 732 of the chassis 730. When the roller body 700 of the assembly rotates during a dispensing action, the bottom end 720 of the clip 710 contacts the surface 732, which prevents the clip 710 from rotating with the roller body 700. In other words, the roller body 700 is able to rotate freely during dispensing while the clip 710 remains approximately stationary. In embodiments, the bottom end 720 of the clip 710 may be positioned relative to the surface 732 such that the clip 710 may have some rotational freedom of movement, such as approximately ten degrees.

As described above, the rib 722 extends outward from the clip 710, such as by the distance h along the bottom end 720 of the clip 710. If sheet product becomes wet and adheres to the roller body 700 during dispensing, the ramp-shaped rib 722, which is stationary relative the rotating roller body 700 during a dispensing action, separates the wet sheet product from the roller body 700 thereby preventing the sheet product from wrapping around the roller body 700 and jamming in the dispenser.

In embodiments, the pinch roller assembly is suitable for use with existing dispensers having a variety of configurations. For example, the roller body 700 may have a length and an outer diameter that is substantially the same as the pinch roller of the existing dispenser, and the clips 710 may be designed to engage the chassis 730 of the existing dispenser. Accordingly, the pinch roller of an existing dispenser can be replaced with the pinch roller assembly having the roller body 700 and clips 710, to reduce the propensity of wet sheet product to adhere to the roller body as it rotates.

In embodiments, the dispenser may be a water resistant style of dispenser that is designed for use in environments in which the dispenser is exposed to water. For example, many industrial environments require periodic and thorough cleaning that can include the use of a hose to wash down the entire environment, including the walls to which a sheet product dispenser may be attached. Accordingly, water resistant dispenser designs include various elements that are used to prevent the sheet product from becoming wet. Such elements include, but are not limited to, a closeable dispensing hatch and one or more rubber gaskets to ensure water stays out of the dispenser during a wash down. While currently available water resistant dispensers include elements to prevent the sheet product from becoming wet during a wash down, the sheet product of the dispensers may still become wet during normal use, i.e., when the dispensing hatch is open. Accordingly, to overcome the problem of wet sheet product adhering to the pinch roller, a pinch roller with clips, as described in detail above, can be used with currently available water resistant dispensers.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A pinch roller assembly for a sheet product dispenser, comprising;

a pinch roller body having a plurality of grooves; and a plurality of clips rotatably coupled to and supported by the pinch roller body, each one of the plurality of clips being disposed in one of the plurality of grooves;

wherein each one of the plurality of clips is configured to remain approximately rotatably stationary with respect to the pinch roller body, when the pinch roller body rotates, wherein each one of plurality of clips is snap-fit to the pinch roller body or completely encircles the pinch roller body.

2. The pinch roller assembly of claim 1, wherein each one of the plurality of clips is removably associated with the pinch roller body.

3. The pinch roller assembly of claim 1, wherein each one of the plurality of clips comprises a hook portion snap-fit or encircling one of the plurality of grooves of the pinch roller body.

4. The pinch roller assembly of claim 1, wherein each of the plurality of clips further comprises a ramp-shaped rib extending along at least a body portion of the clip, the body portion of the clip extending radially outward from the pinch roller body.

5. The pinch roller assembly of claim 1, wherein one of the plurality of clips is positioned within one inch from an end of the pinch roller body.

6. The pinch roller assembly of claim 1, wherein the plurality of clips cover less than twenty percent of a surface area of the pinch roller body.

7. A dispenser for a sheet product, comprising:

a drive roller configured to rotate and thereby dispense the sheet product;

a motor or a user-actuated mechanism configured to rotate the drive roller;

a pinch roller assembly defining, with the drive roller, a nip for receiving the sheet product, the pinch roller assembly comprising:

a pinch roller body having a plurality of grooves; and a plurality of clips rotatably coupled to and supported by the pinch roller body, each one of the plurality of clips being disposed in one of the plurality of grooves, wherein each one of the plurality of clips remains approximately rotatably stationary with respect to the pinch roller body, as the pinch roller body rotates, wherein each one of plurality of clips comprises a body portion extending outward from the pinch roller body to guide the sheet product away from the pinch roller body.

8. The dispenser of claim 7, wherein each one of the plurality of clips is removably associated with the pinch roller body.

9. The dispenser of claim 7, wherein one of the plurality of clips is positioned within one inch of an end of the pinch roller body.

10. The dispenser of claim 7, wherein the plurality of clips cover less than twenty percent of a surface area of the pinch roller body.

11. The pinch roller assembly of claim 1, wherein the plurality of grooves are spaced along the pinch roller body and each groove exposes an inner core of the pinch roller body.

12. The pinch roller assembly of claim 11, wherein the pinch roller body further comprises an outer surface configured to contact the drive roller.

13. The dispenser of claim 7, wherein each one of the plurality of clips comprises a hook portion mated about one of the plurality of grooves of the pinch roller body.

14. The dispenser of claim 7, wherein each one of the plurality of clips further comprises a ramp-shaped rib extending along at least the body portion of the clip, the body portion of the clip extending radially outward from the pinch roller body.

15. The dispenser of claim 7, wherein bottom ends of the body portions of the clips are configured to engage a chassis of a housing of the dispenser.

16. The dispenser of claim 7, wherein bottom ends of the body portions of the clips are configured to abut a portion of the sheet product dispenser such that each one of the plurality of clips remains stationary as the pinch roller body rotates.

17. The dispenser of claim 7, wherein the user actuated mechanism is selected from the group consisting of a lever, a button, and a wheel.

18. A dispenser for a sheet product, comprising:

a drive roller configured to rotate and thereby dispense the sheet product;

a motor or a user-actuated mechanism configured to rotate the drive roller;

a pinch roller assembly defining, with the drive roller, a nip for receiving the sheet product, the pinch roller assembly comprising:

a pinch roller body having a plurality of grooves; and a plurality of clips rotatably coupled to and supported by the pinch roller body, each one of the plurality of clips being disposed in one of the plurality of grooves, wherein each one of the plurality of clips remains approximately rotatably stationary with respect to the pinch roller body, as the pinch roller body rotates, wherein each one of plurality of clips is snap-fit to the pinch roller body or completely encircles the pinch roller body.

19. The dispenser of claim 18, wherein each one of the plurality of clips comprises a hook portion snap-fit or encircling one of the plurality of grooves of the pinch roller body.

20. The dispenser of claim 18, wherein each one of plurality of clips comprises a body portion extending outward from the pinch roller body to guide the sheet product away from the pinch roller body.

* * * * *